US007654337B2

(12) United States Patent
Noël

(10) Patent No.: US 7,654,337 B2
(45) Date of Patent: Feb. 2, 2010

(54) ARRANGEMENT FOR CONTROLLING ROCK DRILLING

(75) Inventor: Roger Noël, Bron (FR)

(73) Assignee: Sandvik Mining and Construction Oy, Tampere (FI)

( * ) Notice: Subject to any disclaimer, the term of this patent is extended or adjusted under 35 U.S.C. 154(b) by 515 days.

(21) Appl. No.: 10/533,873

(22) PCT Filed: Nov. 5, 2003

(86) PCT No.: PCT/FI03/00824

§ 371 (c)(1),
(2), (4) Date: May 19, 2006

(87) PCT Pub. No.: WO2004/042193

PCT Pub. Date: May 21, 2004

(65) Prior Publication Data

US 2007/0007039 A1 Jan. 11, 2007

(30) Foreign Application Priority Data

Nov. 5, 2002 (FI) ..... 20021980
Feb. 28, 2003 (FI) ..... 20030320

(51) Int. Cl.
*E21B 45/00* (2006.01)
*E21B 4/14* (2006.01)

(52) U.S. Cl. ..... 173/1; 173/2; 173/4; 173/5

(58) Field of Classification Search ..... 173/1, 173/2, 4, 8, 11; 60/468, 422; 137/487.5
See application file for complete search history.

(56) References Cited

U.S. PATENT DOCUMENTS 3,561,542 A 2/1971 Hanson et al.
3,581,830 A 6/1971 Stoner
3,823,729 A 7/1974 Swogger
4,165,789 A 8/1979 Rogers
4,195,699 A 4/1980 Rogers et al.
4,275,793 A 6/1981 Schivley, Jr. et al.
4,431,020 A 2/1984 Kowalski
4,711,090 A 12/1987 Hartiala et al.
4,967,557 A * 11/1990 Izumi et al. ..... 60/423
4,967,791 A 11/1990 Sternberger
5,121,802 A * 6/1992 Rajala et al. ..... 173/1
5,333,451 A * 8/1994 Sakikawa et al. ..... 60/468
5,347,811 A 9/1994 Hasegawa et al.
5,771,981 A 6/1998 Briggs et al.
5,778,990 A 7/1998 Niemi
5,826,613 A 10/1998 Schalk (Continued)

FOREIGN PATENT DOCUMENTS

EP 0 080 446 A2 6/1983

(Continued)

OTHER PUBLICATIONS

An Opposition issued by fax on Feb. 27, 2008 issued in European Application No. 03810474.1 (European Publication No. 1 558 836 ).

*Primary Examiner*—Stephen Garbe
*Assistant Examiner*—Nathaniel Chukwurah
(74) *Attorney, Agent, or Firm*—Drinker Biddle & Reath LLP

(57) ABSTRACT

A method for controlling rock drilling and a rock drilling arrangement having at least one feed channel of a feed actuator provided with a restrictor, which causes a pressure drop if the penetration rate increases and, consequently, a flow through the restrictor increases. A pressure difference and an increase in the penetration rate can be detected by sensing the pressure before the restrictor and after the restrictor. When the feed rate increases, a hydraulic system is arranged to decrease percussion pressure.

17 Claims, 9 Drawing Sheets

U.S. PATENT DOCUMENTS

| | | | | |
|---|---|---|---|---|
| 6,176,324 | B1 | 1/2001 | Cadet | |
| 6,408,622 | B1 | 6/2002 | Tsuruga et al. | |
| 6,422,256 | B1 | 7/2002 | Balazy et al. | |
| 6,505,689 | B1 * | 1/2003 | Poysti et al. | 173/4 |
| 2002/0179150 | A1 * | 12/2002 | Balazy et al. | 137/487.5 |
| 2006/0011360 | A1 | 1/2006 | Noel | |

FOREIGN PATENT DOCUMENTS

| | | | |
|---|---|---|---|
| EP | 0 112 810 | A2 | 4/1984 |
| EP | 0 384 888 | | 6/1992 |
| EP | 1 146 267 | | 10/2001 |
| FI | 90277 | | 9/1993 |

* cited by examiner

ARRANGEMENT FOR CONTROLLING ROCK DRILLING

BACKGROUND OF THE INVENTION

The invention relates to a method for controlling rock drilling, wherein a percussion device belonging to a rock drill machine delivers impact pulses to rock through a tool and wherein the rock drill machine is simultaneously pushed against the rock by means of a feed actuator, the method comprising: feeding a pressure medium to the feed actuator along at least one feed channel; feeding the pressure medium to the percussion device along at least one percussion pressure channel; determining a penetration rate; and adjusting at least a percussion pressure on the basis of the penetration rate.

The invention further relates to a rock drilling arrangement comprising: a rock drill machine including a percussion device arranged to generate impact pulses to a tool to be connected to the rock drill machine; a feed beam whereon the rock drill machine has been arranged; a feed actuator enabling the rock drill machine to be moved in the longitudinal direction of the feed beam; a pressure medium system comprising: at least one pressure source; at least one pressure medium channel leading to the percussion device; at least one feed channel connected to the feed actuator; and means for adjusting a percussion pressure, When holes are drilled into rock, the drilling conditions may vary in several ways. The rock may include voids and cracks, and rock layers having different hardness, which is why drilling parameters should be adjusted according to the resistance opposed to the drilling bit.

Conventionally, an operator controls the operation of a rock drill machine on the basis of his or her personal experience. The operator sets certain drilling parameters on the basis of the presumed rock characteristics. During drilling, the operator checks the rotation and monitors the progress of the drilling. When necessary, he changes the feed force and/or the percussion power of the percussion device to suit a particular type of rock, thus trying to achieve a fast but still smooth drilling process. In practice, the operator is able to adjust one only drilling parameter and control its influence on the drilling process in several seconds or tens of seconds. When the quality of rock or the drilling characteristics thereof changes rapidly, even a qualified operator cannot adapt the drilling parameters quickly enough to suit the rock. It is thus obvious that the operator cannot ensure a good tool life if drilling conditions vary rapidly. Furthermore, it is practically impossible even for a qualified operator to monitor and control the operation of the rock drilling machine during an entire working shift such that the drilling progresses efficiently at every moment, simultaneously taking into account the stresses the tool is subjected to.

BRIEF DESCRIPTION OF THE INVENTION

An object of the invention is to provide a novel and improved method for controlling rock drilling, and a rock drilling arrangement.

The method of the invention is characterized by conveying at least one pressure medium flow supplied to or from the feed actuator through at least one restrictor, sensing the pressure of the pressure medium before the restrictor and after the restrictor in order to determine the penetration rate, and adjusting the percussion pressure on the basis of the monitoring.

The rock drilling arrangement of the invention is characterized in that at least one restrictor is connected to at least one feed channel of the feed actuator, the arrangement comprises means for sensing the pressure active in the feed channel before the restrictor and after the restrictor, and the pressure medium arrangement is arranged to decrease the percussion pressure when the pressure in the feed channel after the restrictor is smaller than the pressure before the restrictor.

A second rock drilling arrangement of the invention is characterized in that the arrangement comprises at least one adjustment unit for controlling the feed actuator, at least two relief valves arranged in series in load-sense channel of the adjustment unit, at least one restrictor connected to the inlet feeding channel of the feed actuator, the arrangement comprises means for controlling the pressure difference between the inlet feeding channel of the feed actuator and a reference pressure sensed in-between the mentioned two relief valves in the load-sense circuit of the adjustment unit of the feed actuator, the reference pressure in-between the two relief-valves is sensed, the pressure after the restrictor is sensed, and the arrangement comprises a control system which is arranged to decrease the percussion pressure when the pressure difference between the above-mentioned sensed pressures decreases.

The idea underlying the invention is that a restrictor is arranged in at least one pressure medium channel leading to a feed actuator. The restrictor may be arranged in a channel along which the pressure medium is fed to the feed actuator when a rock drill machine is fed towards rock, or the restrictor may be arranged in a channel along which the pressure medium returns from the feed actuator. The pressure of the pressure medium is sensed or measured before and after the restrictor, which provides pressure information to be utilised for controlling the operation of the rock drill machine. If the penetration rate increases in soft rock for example, the feed flow increases and a larger pressure medium flow flows to the feed device. A larger flow through the restrictor creates a higher pressure drop. A drop in the pressure can be detected when the pressure active on both sides of the restrictor are compared The invention further includes adjusting, on the basis of the pressure difference measured on both sides of the restrictor, the percussion pressure such that when the penetration rate increases, the percussion pressure is decreased.

An advantage of the invention is that changes in the penetration rate can be sensed in a relative accurate manner by sensing the pressure drop or the pressure differential at two selected points of the hydraulic circuit. Such sensing of the pressure difference is relatively simple to arrange and alternative solutions exist for the implementation thereof. The invention may further include adjusting the percussion pressure automatically in a certain predetermined proportion to the pressure drop induced by the penetration rate. Since the invention includes decreasing the percussion pressure in soft rock, it is possible to avoid the formation of harmful tensile stresses on drilling equipment.

The idea underlying an embodiment of the invention is that the pressure before the restrictor and after the restrictor is measured by pressure sensors. Measurement data is delivered to a control unit wherein a predetermined control strategy has been determined, the percussion pressure being controlled with respect to the feed rate according to such a strategy. The control unit is arranged to control at least one electrically controlled valve. The control unit can be provided with various different adjustment strategies. In addition, it is relatively easy to change the adjustment strategies later. The control unit may also control a feed pressure according to a predetermined control strategy. It is also possible the control the feed pressure with the restrictor only, without additional control valve.

The idea underlying an embodiment of the invention is that the control unit comprises a processor, the computer program to be executed therein being configured to decrease the feed pressure and the percussion pressure when the feed rate increases. In this solution, it is very simple and quick to update the control. A new program product provided with a new adjustment strategy may be downloaded into the control unit later.

The idea underlying an embodiment of the invention is that at least one monitoring valve arranged to automatically decrease the percussion pressure when the feed rate increases is connected to a hydraulic circuit.

The idea underlying an embodiment of the invention is that the monitoring valve is arranged to control a load-sense valve or directly a load-sense pump of the hydraulic system.

The idea underlying an embodiment of the invention is that a pressure ratio at which the percussion pressure vary and the feed pressure may vary is substantially constant during the drilling.

The idea underlying an embodiment of the invention is that the hydraulic circuit enables an operator to fine-tune the feed pressure without affecting the percussion pressure.

BRIEF DESCRIPTION OF THE DRAWINGS

The invention will be described in closer detail in the accompanying drawings, in which.

For the sake of clarity, the figures show the invention in a simplified manner. Same reference numerals identify similar elements.

DETAILED DESCRIPTION OF THE INVENTION

Figure 1:
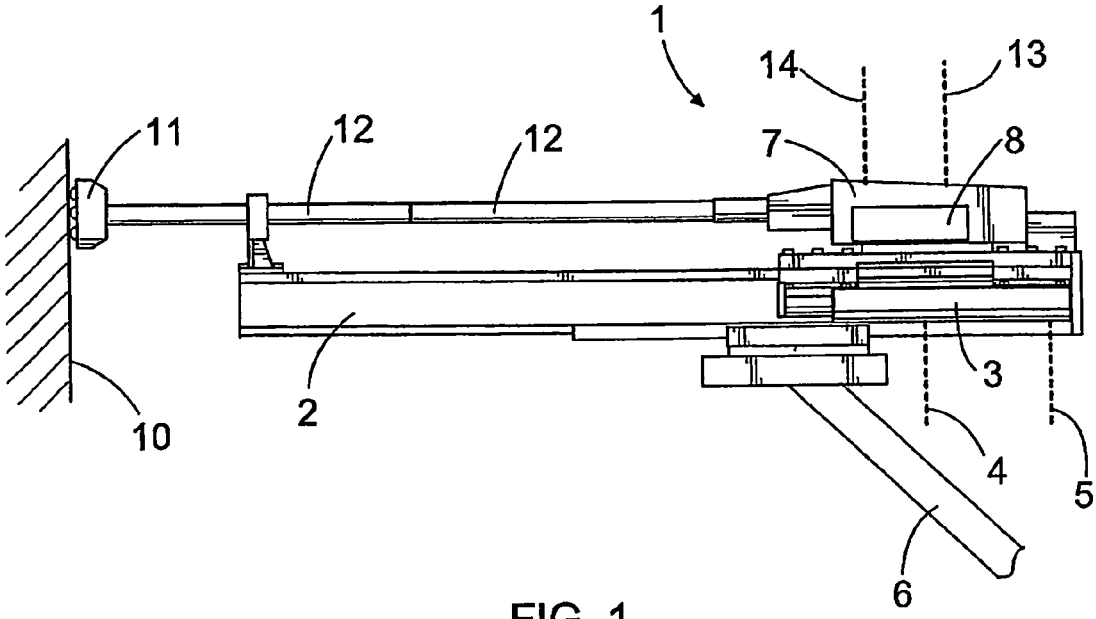
FIG. 1 is a schematic side view showing a rock drilling unit.

The rock drilling unit shown in FIG. 1 comprises a rock drill machine 1 arranged on a feed beam 2. The rock drill machine 1 can be moved in the longitudinal direction of the feed beam 2 by means of a feed device 3. The feed actuator 3 is arranged to affect the rock drill machine 1 through a power transmission element, such as a chain or a wire. The feed actuator 3 may be a pressure medium cylinder or a pressure medium motor whereto a pressure medium may be conveyed and wherefrom the pressure medium may be removed along a first channel 4 and a second channel 5, depending on the direction of movement of the feed device 3. The rock drill machine 1 and a tool 9 connected thereto are pressed against rock 10 by using a feed force of a desired magnitude. The feed beam 2 may be movably arranged at a free end of a drilling boom 6 belonging to the rock drilling apparatus. The rock drill machine 1 comprises at least a percussion device 7 and a rotating device 8. The percussion device is used for generating impact pulses to the tool 9 connected to the rock drill machine 1, the tool delivering the impact pulses to the rock 10. An outermost end of the tool 9 is provided with a drill bit 11, the bits therein penetrating the rock 10 due to the impact pulses, causing the rock 10 to break. Furthermore, the tool 9 is rotated with respect to its longitudinal axis, which enables the bits in the drill bit 11 always to be struck at a new point in the rock 10. The tool 9 is rotated by means of the rotating device 8, which may be e.g. a pressure medium operated device or an electric device. The tool 9 may comprise several drill rods 12 arranged on each other consecutively. Screw joints may be provided between the drill rods 12. In the solution of the invention, the percussion device 7 is a hydraulically operated device whereto a pressure medium is conveyed along a percussion pressure channel 13. A pressure medium flow supplied from the percussion device 7 is conveyed to a tank along a discharge channel 14. The percussion device 7 may comprise a percussion piston, which is moved to and fro by means of a pressure medium and which is arranged to strike upon a tool or a shank adapter arranged between a tool and a percussion piston. Of course, the invention may also be applied in connection with pressure medium operated percussion devices 7 wherein impact pulses are generated in a manner other than by means of a percussion piston moved to and fro.

Figure 2:
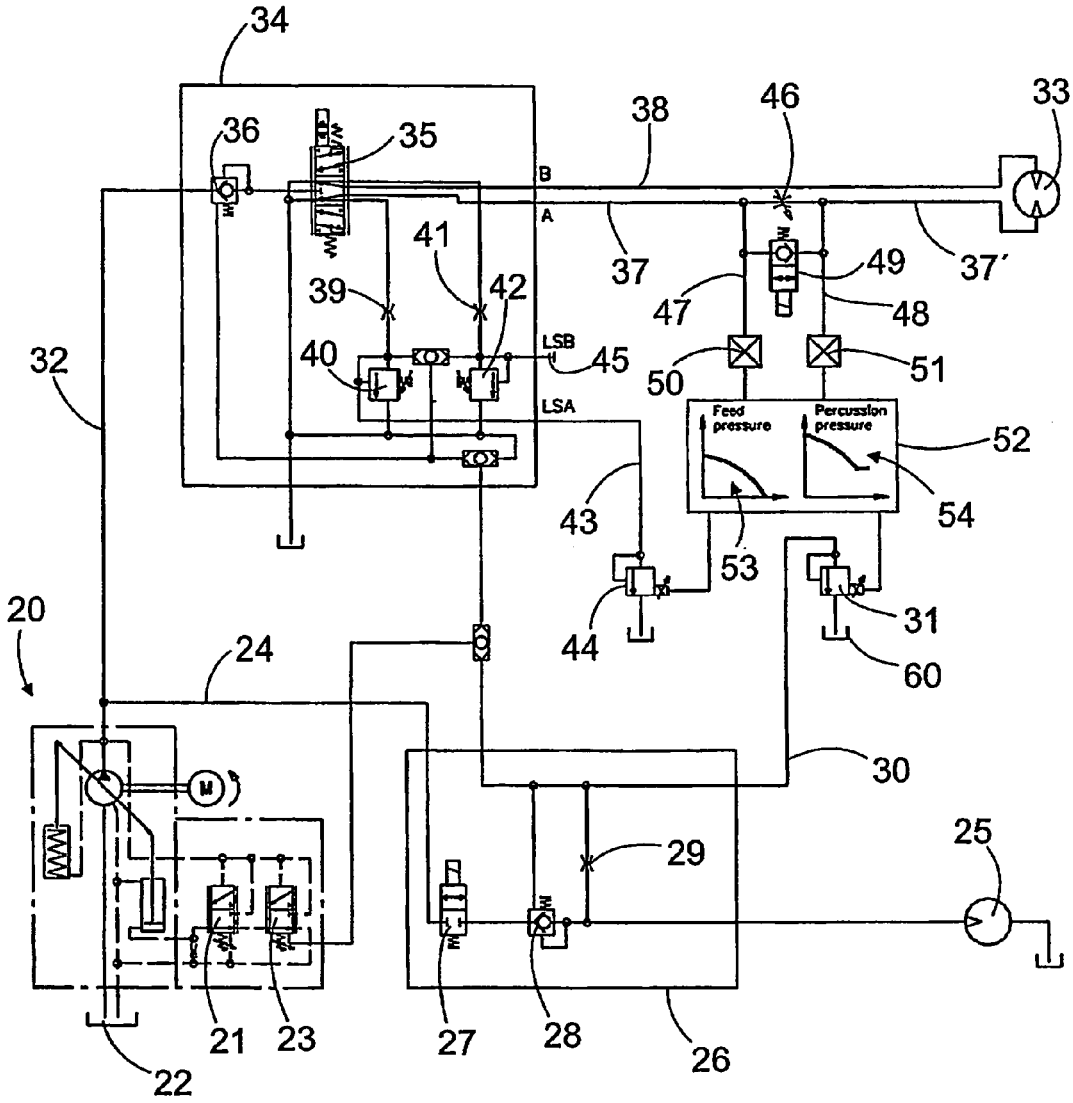
FIGS. 2 to 8 schematically show hydraulic diagrams showing different embodiments for adjusting a percussion pressure on the basis of a penetration rate.

FIG. 2 shows an embodiment of the invention. A hydraulic circuit comprises a pump 20 for generating the necessary pressure and flow for the pressure medium. When necessary, the number of pumps 20 may be larger. Furthermore, the pump 20 may be a fixed displacement pump or a variable displacement pump. The solution shown in FIG. 2 utilises a load-sense control. The pump 20 is a variable displacement pump provided with adjustment elements for adjusting the pressure and flow produced by the pump 20. The adjustment elements of the pump 20 may include a valve 21, which may protect the pump 20. The adjustment elements of the pump 20 may further include a load-sense valve 23. A pressure medium is conveyed from the pump 20 to a percussion device 25 along a percussion pressure channel 24. The percussion medium to be conveyed to the percussion device 25 can be controlled by means of a first control unit 26, which may comprise a valve 27 for switching the percussion device 25 on/off, and furthermore, a compensator valve 28 and a restrictor 29. The pressure medium is conveyed to a load-sense channel 30 through the restrictor 29. The pressure of the load-sense channel affects the compensator valve 28 and the load-sense valve 23 of the pump 20. The pressure active in the load-sense channel 30 may be controlled by means of a first electrically controlled adjustment valve 31.

Furthermore, the pressure medium is conveyed from the pump 20 to a feed actuator 33 along a channel 32. The pressure medium conveyed to the feed actuator 33 is adjusted by means of a second adjustment unit 34. The second adjustment unit 34 may comprise a directional control valve 35 and a compensator valve 36, which are together arranged to control and adjust the pressure medium flows to be conveyed to the feed actuator 33. When the rock drill machine 2 is fed towards the rock during drilling, the pressure medium is conveyed to the feed actuator 33 along a feed channel 37 while the pressure medium returns from the feed actuator 33 along feed channel 38 back to tank. Correspondingly, during a return movement, i.e. when the rock drill machine 1 is moved away from the rock, the pressure medium is fed along the feed channel 38 to the feed actuator 33 and, simultaneously, the pressure medium flows along the feed channel 37 away from the feed actuator 33. The flow and pressure of the first feed channel 37 can be adjusted by means of the second adjustment unit 34. In order to adjust the pressure, the adjustment unit 34 is provided with a restrictor 39 and a pressure relief valve 40. The pressure of the second feed channel 38 can be restricted in a similar manner by means of a restrictor 41 and a pressure relief valve 42. Furthermore, the pressure of the feed channel 37 may be affected by adjusting an electrically controlled pressure relief valve 44 arranged in the load-sense channel 43, for decreasing the pressure below the fixed value set by the relief valve 40.

According to the idea of the invention, a restrictor 46 is arranged in the first feed channel 37 on a section between the second adjustment unit 34 and the feed actuator 33. The restrictor 46 may be adjustable. A section between the restrictor 46 and the adjustment unit 34 from the channel 37 is connected to a first sensing channel 47 while a section 37' between the restrictor 46 and the feed actuator 33 is connected to a second sensing channel 48. A valve 49 may be arranged between the channel 37 and the channel 37' to bypass the restrictor 46 for auxiliary functions, namely for fast retract and fast forwards movements of the feed actuator 33. Furthermore, a pressure sensor 50 is connected to the first sensing channel 47 and a pressure sensor 51 is connected to the second sensing channel 48. The pressure sensors 50 and 51 may then be used for measuring the pressures active on both sides of the restrictor 46. From the pressure sensors 50 and 51, measurement data is delivered to a control unit 52 which, on the basis of the measurement data and control parameters supplied thereto, is arranged to control the adjustment valve 31 for affecting a percussion pressure, and further, the control unit 52 is also arranged to control the adjustment valve 44 for affecting a feed pressure. The control unit 52 may be a computer or a similar device whose processor is capable of executing a computer program. FIG. 2 illustrates a control principle by curves 53 and 54. Curve 53 includes the penetration rate on the horizontal axis and the feed pressure on the vertical axis. Curve 54 includes the penetration rate on the horizontal axis and the percussion pressure on the vertical axis. When the penetration rate increases, the control unit 52 is arranged, to decrease the feed pressure, according to curve 53. Correspondingly, when the penetration rate increases, the control unit 52 is arranged to decrease the percussion pressure, according to curve 54. The curves 53 and 54 are computed in order to show the correct pressure relation, in order to achieve an optimum drilling process at any penetration rate. Furthermore, a minimum percussion pressure may be controlled by curve 54 to prevent pressure accumulators of the percussion device 25 from being damaged.

Figure 3:
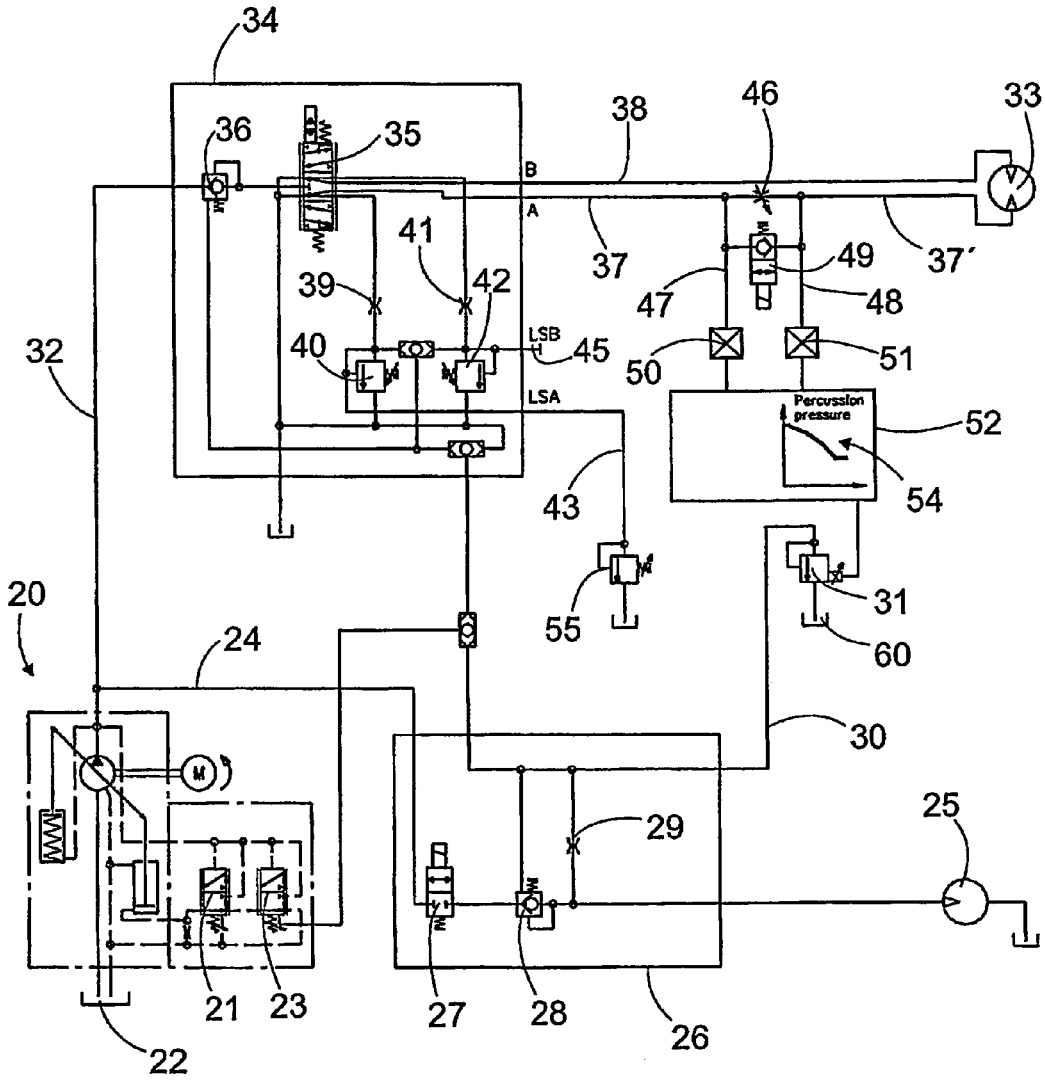

The hydraulic circuit shown in FIG. 3 is a simplified embodiment of the hydraulic circuit shown in FIG. 2. In the FIG. 3, a simple pressure relief valve 55 is arranged in the load-sense channel 43, instead of an electrically controlled valve 44. The feed channel 37 is then subject to a constant pressure, set by the pressure relief valve 55 together with the compensator valve 36. In this simplified embodiment, the restrictor 46 is rated to precisely provide the expected pressure drop from feed channel 37 to feed channel 37', depending on penetration rate. The pressure setting achieved with a pressure relief valve 55 may also be achieved with a pressure relief valve 40, but for fine adjustment of the feed pressure by the operator, it may be easier to place a separate pressure relief valve 55 inside the cabin. Furthermore the control unit 52 is arranged to adjust the percussion pressure according to curve 54, with help of the pressure information sensed by the pressure sensors 50 and 51. With a correct control by curve 54, the simplified circuit shown in FIG. 3 is able to duplicate the control of the drilling parameters in the same way as the circuit shown in FIG. 2.

Figure 4:
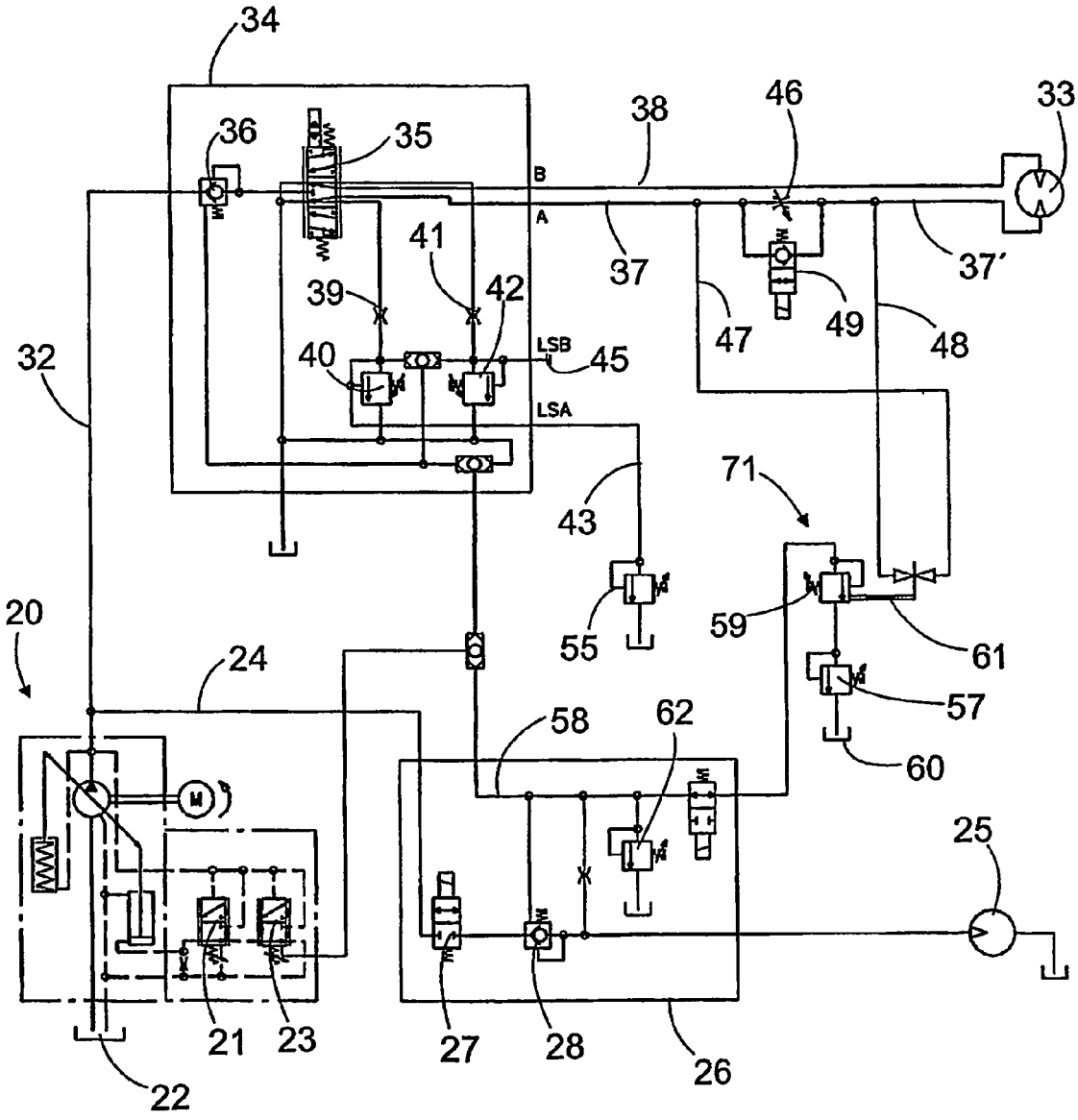

FIG. 4 shows a hydraulic circuit wherein the control of the invention is implemented by using hydraulic components only. The hydraulic circuit of FIG. 4 lacks pressure sensors 50, 51, a control unit 52 and electrically controlled adjustment valves 31 and 44 as well. In this solution, the feed pressure is controlled by the pressure relief valve 40 or 55, as in FIG. 3. The percussion pressure is controlled by means of the compensator valve 28 and the pressure active in the load-sense channel 58. The pressure in the load-sense channel 58 is controlled by means of a monitoring valve 71 and a pressure relief valve 57 in series. The monitoring valve 71 is shown later in FIG. 10. When the monitoring valve 71 is fully open, the pressure relief valve 57 sets the minimum percussion pressure. With the help of the spring 59 or corresponding force element of the monitoring valve 71, the percussion pressure can be increased to a desired maximum percussion pressure. Moreover the percussion pressure can be decreased in the predetermined range (maximum to minimum) by the pressures in sensing channels 47 and 48 acting on the control element 61. The pressure difference in the sensing channels 47 and 48 is purely dependent on the actual penetration rate.

The structure of the monitoring valve 71 may resemble that of a pressure relief valve. The pressure in the load-sense channel 58 is set by the spring 59 of the monitoring valve 71 and a spring of the pressure relief valve 57. The monitoring valve 71 is provided with a control element 61 arranged to affect the opening of the channel leading to the tank 60. The control element 61 is affected by the pressures sensed by sensing channels 47 and 48 on both sides of the restrictor 46. If the feed rate increases, the restrictor 46 causes the pressure in the second sensing channel 48 to be lower than the pressure in the first sensing channel 47. The pressure of the first sensing channel 47 then affects the control element 61 more powerfully than the pressure of the second sensing channel 48, in which case the monitoring valve 71 moves to the left and, via the valve 57, opens the connection to the tank 60, and forces the impact pressure to decrease. FIG. 4 also shows that the adjustment unit 26 may comprise a pressure relief valve 62, which can be used for specifically adjusting a lower maximum percussion value for the percussion pressure to be conveyed to the percussion device 25.

Figure 5:
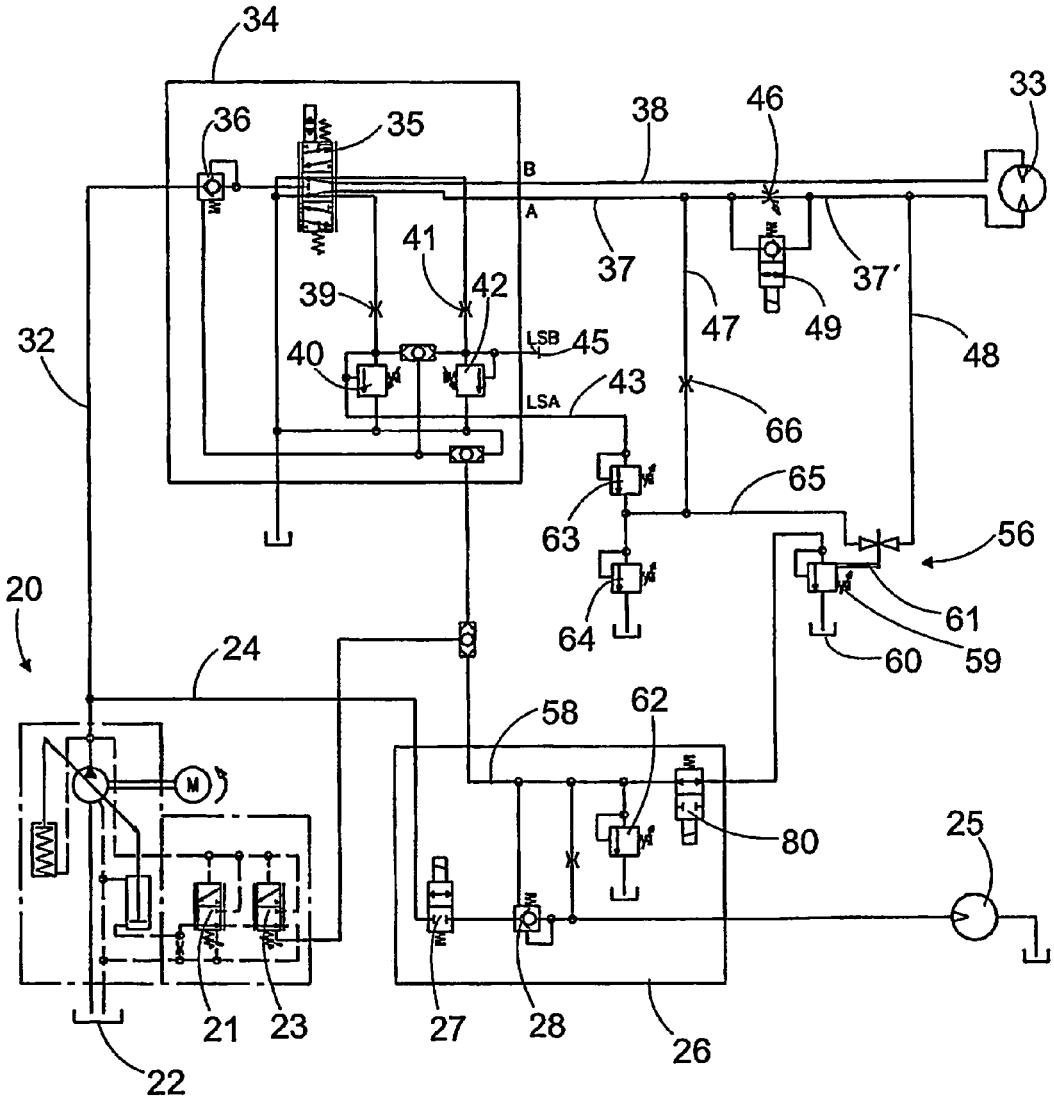
Figure 9:
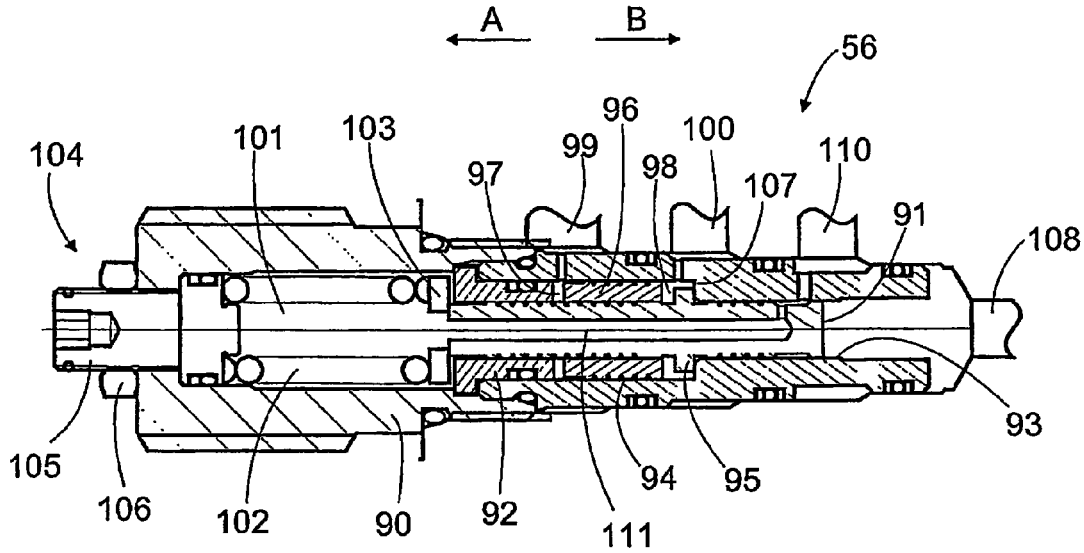
FIG. 9 is a schematic and sectional view showing the structure of a monitoring valve applicable to the hydraulic circuits disclosed in FIGS. 5 to 8.

In an embodiment shown in FIG. 5, the load-sense channel 43 is connected to two pressure relief valves 63 and 64 in series. The pressure in-between the relief valves 63 and 64 is designated as a reference pressure. The percussion pressure is controlled by a monitoring valve 56, which is shown in FIG. 9. The monitoring valve 56 comprises a spring 59 for setting a minimum percussion pressure. A control element 61 of the monitoring valve 56 initiates a pressure ratio control on the percussion pressure as soon as the feed pressure sensed in the sensing channel 48 is higher than the reference pressure in the sensing channel 65. The information to the monitoring valve 56 is no longer a pressure drop from channel 37 to 37' as in FIG. 4. Instead, the monitoring valve 56 senses the difference of pressures in the channel 37' and the sensing channel 65. In order to achieve a precise reference pressure in any working conditions, a restrictor 66 provides a small amount of pressure medium to the relief valve 64. This flow can be led from any section of the hydraulic circuit, but the flow can also be taken from channel 47. In this embodiment the channel 47 is not considered to be a sensing channel. The embodiment of FIG. 5 further allows, by setting the pressure relief valve 63, to simultaneously increase or decrease the feed pressure and the percussion pressure in the predefined ratio given by the monitoring valve 56. Moreover by setting the relief valve 64, the operator may independently set the feed pressure and thereby fine-tune the drilling.

As shown in FIG. 5, a restrictor 46 may be connected in-between the feed channels 37 and 37'. The hydraulic circuit may also comprise a sensing channel 48 for sensing the pressure variations caused by the changes in the penetration rate. The pressure variations in the feed line 37' induced by a variable penetration rate act in the same way as variations on the setting of the pressure relief valve 63. On one side, the action on the relief valve 63 can only be manual, while on the other side the action induced by restrictor 46 is automatically related to the penetration rate. This somewhat more complex solution shown in FIG. 5 is able to define the percussion pressure depending on the penetration rate, without sensing the feed pressure in feed channel 37. However, the end result with respect to the penetration rate is substantially similar in FIG. 5 and in FIG. 4.

Figure 6:
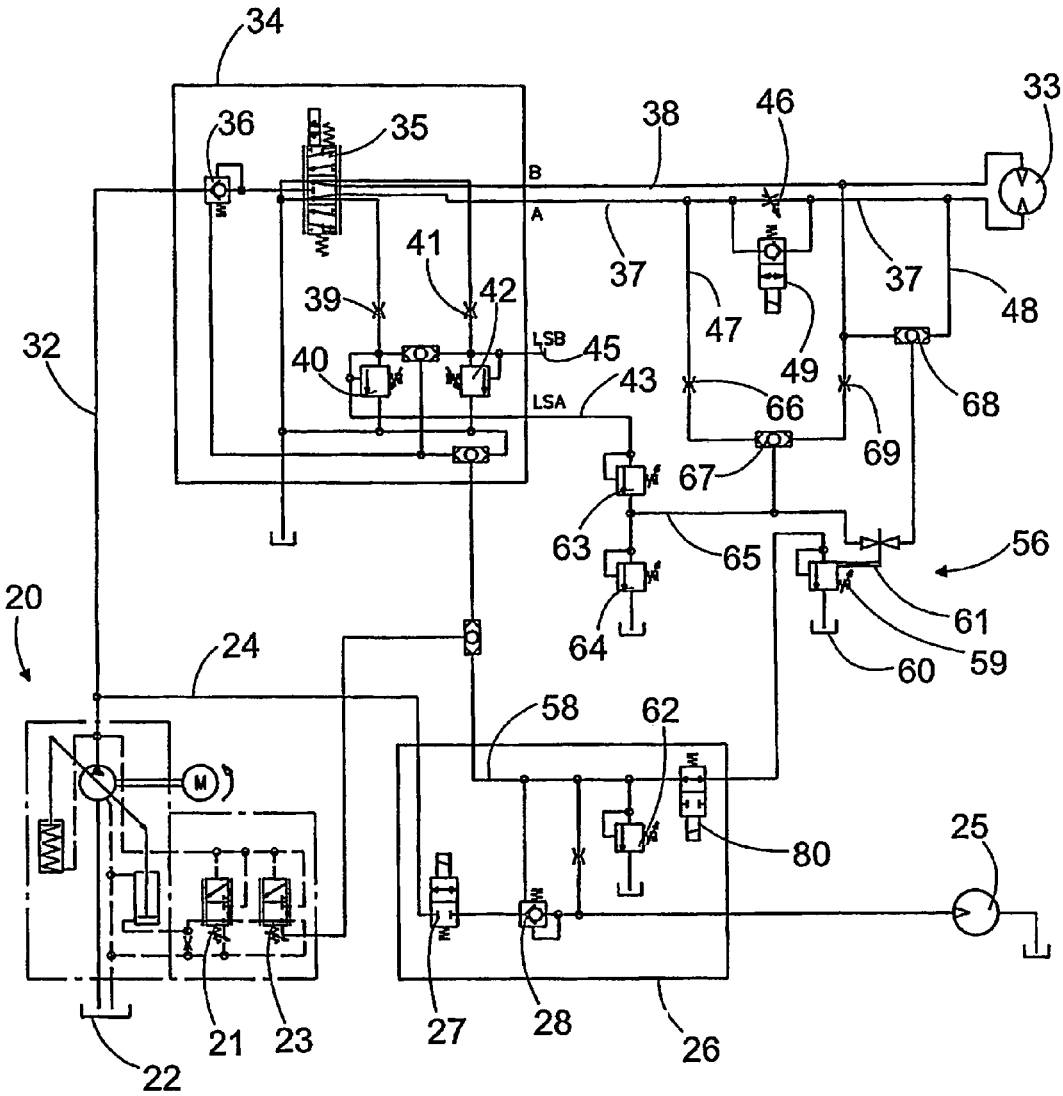

FIG. 6 shows another improvement of the hydraulic system, taking in account the multiple requirements of a drilling system in addition to the pure drilling process. The underlying idea of this embodiment is to automatically increase the percussion pressure to the maximum level, when the drill string gets stuck in retract mode. The idea is that a higher percussion pressure may vibrate the drill string loose and disengage the stuck tool 9. This embodiment includes one additional sensing line 70 connected to the feed channel 38, which is pressurised in retract mode. The shuttle valve 68 selects the highest pressure sensed by a sensing channel 48 in forwards motion, or sensed by a sensing channel 70 in retract motion. This connection allows to increase the percussion pressure when the feed retract pressure increases. Because the feed channel 38 lacks a restrictor, this connection is not sensitive to the retract speed. Furthermore, the reference pressure formed in the sensing channel 65 is secured by adding a restrictor 69 and a shuttle valve 67 to continuously feed the relief valve 64 in forwards motion as well as in retract motion.

Figure 7:
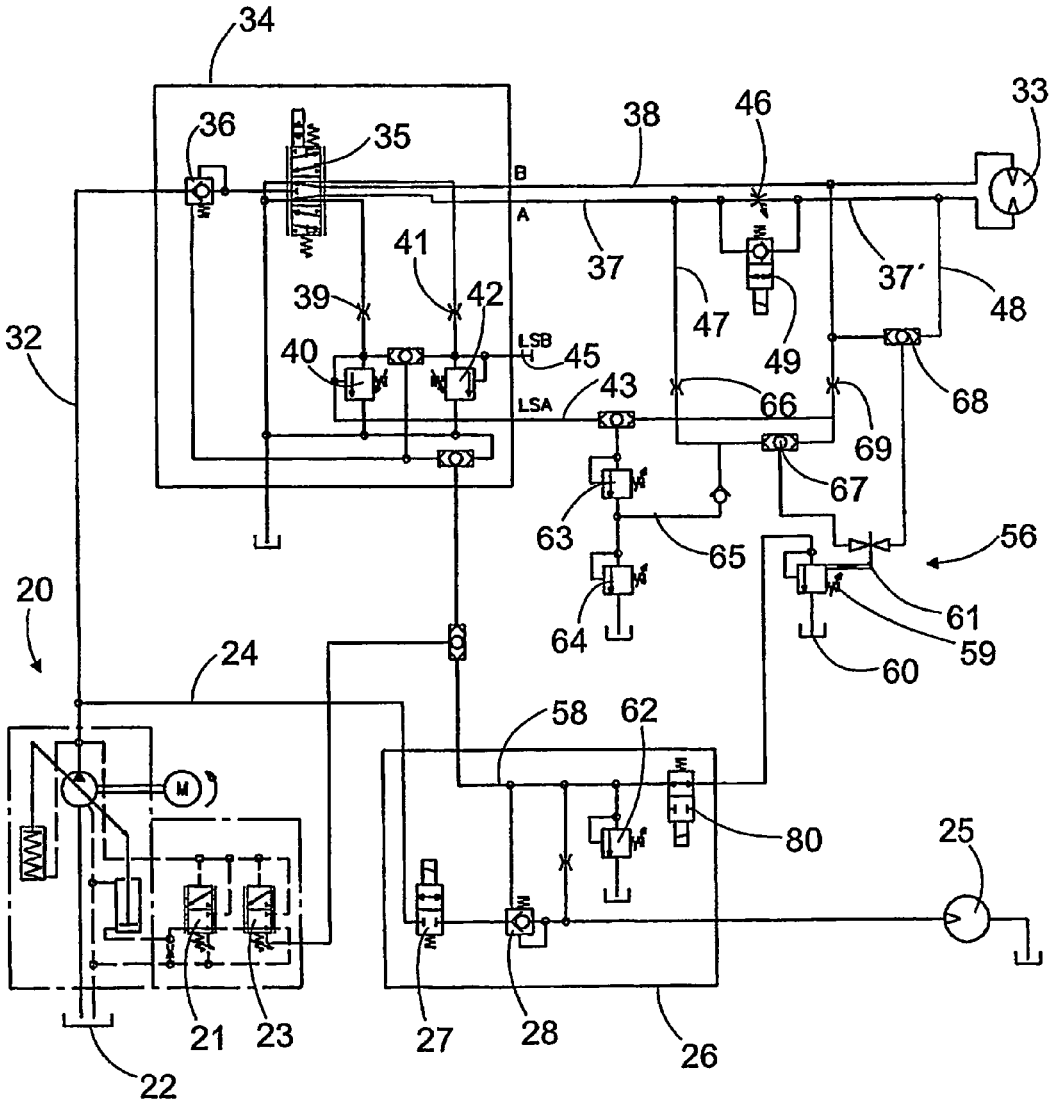

FIG. 7 shows an improvement of previous schematic. The underlying idea is to limit the influence of maximum percussion in retract mode. The solution is to modify in retract mode of actuator 33 the reference pressure set by the pressure relief valve 64, and conveyed by a sensing line 65 to the monitoring valve, and replace it by a possible higher pressure value. The higher pressure value might be set by an additional pressure relief valve (not shown), but an alternative solution is to use the available pressure at the inlet of the two pressure relief valves 63 and 64 in series. This higher pressure is secured in retract mode by a connection 75 sending the pressure medium from restrictor 69 to the pressure relief valves 63 and 64 via a shuttle valve 76. This higher pressure is sensed via the shuttle valve 67 by the control element 61 of the monitoring valve 59 and acts as a reference pressure, to which the effective feed pressure in feed channel 38 is opposed.

Figure 8:
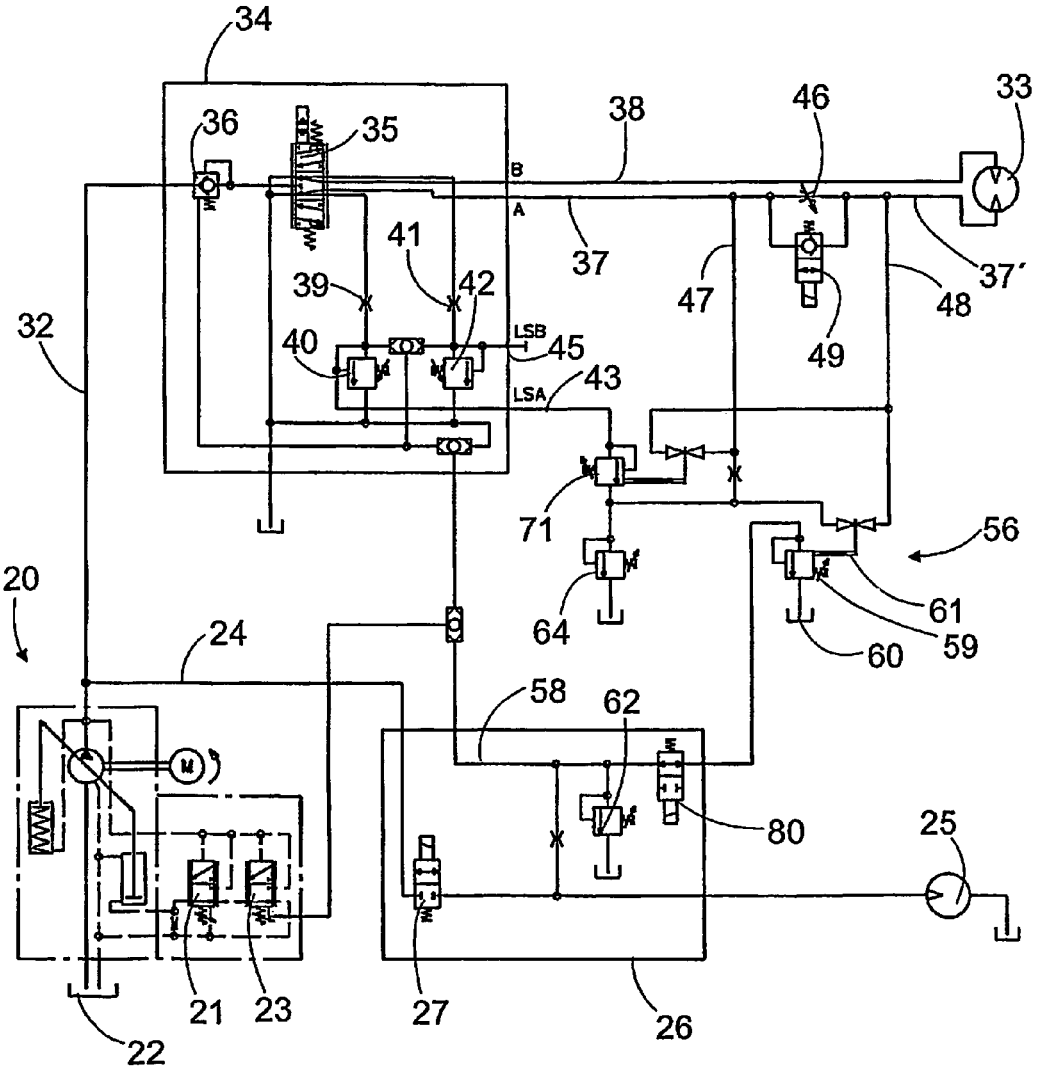
Figure 10:
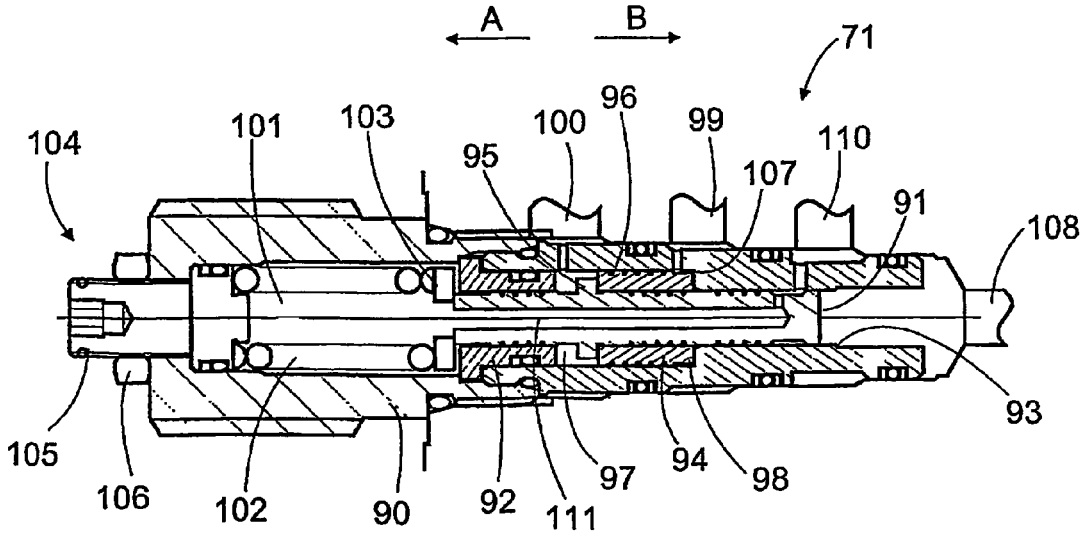
FIG. 10 is a schematic and sectional view showing the structure of a monitoring valve applicable to the hydraulic circuits disclosed in FIGS. 4 and 8.

FIG. 8 shows an embodiment wherein the hydraulic system has been simplified. For cost reasons, the hydraulic pressure medium required by the feed actuator 33 and the percussion device 25 might be generated by means of one only pump. The compensator valve 28 is a very large and expensive hydraulic valve, so to comply with the large pressure medium flow conveyed to the percussion device 25. The underlying idea is that the compensator valve 28 can be omitted. The idea is to decrease in the feed channel 37 the pressure requirement set by the two relief valves 63 and 64 in series as shown in FIG. 5, and keep this pressure requirement anytime substantially lower than the pressure requirement of the percussion device 25. The new feature can be achieved in replacing the pressure relief valve 63 by a monitoring valve 81, which is shown in FIG. 10. The nominal feed pressure is set as usually by the spring 59 of the monitoring valve 81, but this maximum feed pressure may be derated, when penetration rate increases, by the pressure difference between a sensing channel 47 and a sensing channel 48 on both sides of restrictor 46. When drilling in soft rock, the flow through the restrictor 46 increases, resulting in a pressure drop from the feed channel 37 to the feed channel 37'. This pressure difference is utilised for controlling the monitoring valve 81. When the flow through the restrictor 46 increases, the monitoring valve 81 decreases the pressure requirement in the load-sense line 43, and thus also in the feed channel 32. The idea is to keep anytime the pressure requirement of the second adjustment unit 34 lower than the pressure requirement of the percussion device 25. This improvement shown in FIG. 8 can of course apply to FIGS. 6 and 7, where the pressure relief valves 63 may be replaced by a monitoring valve 81.

FIGS. 5 to 8 further show that the first adjustment unit 26 may comprise a valve 80 arranged in the load-sense channel 58 between the pressure relief valve 62 and the monitoring valve 56. This valve 80 enables a full percussion pressure to be set, irrespective of the pressure sensed over the restrictor 46. It is not to be used while drilling, but for rattling the drill rods loose when the hole is completed.

FIG. 9 further shows a possible construction of the monitoring valve shown in FIGS. 5 to 8. The valve 56 may be a spool valve comprising a body 90 and an elongated slide 91 arranged in a space in the body. The cross-section of the slide 91 may be circular, and it has a first end and a second end whose diameters may be substantially equal in size. The first end of the slide 91 is arranged substantially pressure-tight with respect to the body 90, e.g. by means of a detachable sleeve 92. The outer rim of the second end of the slide 91 is sealed to a bore 93 in the body 90. The body 90 may be provided with a pressure space 94 between the sealed ends. Furthermore, a middle section of the slide 91 may be provided with a collar 95 arranged in the pressure space 94. The diameter of the collar 95 is larger than the diameter of the first end and the second end of the slide. On the other hand, the diameter of the collar 95 is smaller than the diameter of the pressure space 94, which means that the collar 95 does not come into contact with the walls defining the pressure space 94. Consequently, the collar 95 does not restrict the flow of a pressure medium in the pressure space 94. The movement of the slide 91 in direction B is restricted such that the collar is arranged to settle against an end surface of the pressure space 94 when the slide 91 is in its right-hand extreme position. Furthermore, an elongated sleeve 96 is arranged around the slide 91. The sleeve 96 is movable in the axial direction in the pressure space 94. The inner rim of the sleeve 96 is sealed with respect to a shaft of the slide 91, to a section at the front of the collar 95. The sleeve 96 is thus allowed to move in the axial direction with respect to the slide 91. The outer rim of the sleeve 96 is sealed to the body 90. A front chamber 97 then resides on the side of the first end of the sleeve 96 while a rear chamber 98 resides on the side of the second end. Due to the sealing, the chambers 97, 98 are not connected to each other. Furthermore, hydraulic channels 99, 100 lead to the pressure space 94. The front chamber 97 is connected to a sensing channel 99 while the rear chamber 98 is connected to a reference channel 100.

On the side of the first end of the slide 91 there is provided a space 101 in the body 90 wherein a spring 102 may be arranged which may be a compression spring or any other spring or force element enabling a corresponding function. The first end of the slide 91 and the spring 102 may come into contact with each other either directly or a sleeve or another coupling element 103 may be arranged in-between. The monitoring valve further comprises control elements 104 for adjusting the force effect of the spring 102. The control elements 104 may include e.g. an adjustment screw 105 for compressing, i.e. pretightening, the spring 102, and also a locking nut 106 for locking the adjustment screw 105 into a desired position. In the situation shown in FIG. 9, the spring 102 has pushed the slide 91 in direction B to an extreme right-hand position, i.e. such that the collar 95 resides against an end surface 107 of the pressure space 94.

As can be further seen in FIG. 9, the end surface of the second end of the slide 91 is connected to a channel leading to a load-sense channel 108. Furthermore, a connection is provided from the bore 93, whereto the second end of the slide 91 has been sealed, to a discharge channel 110. In addition, the slide 91 may be provided with a channel 111 in the longitudinal direction which interconnects the discharge channel 110 and the space 101 on the front side of the first end of the slide 91. Possible leakage flows are allowed to flow into a tank along the channel 111.

The operation of the monitoring valve 56 shown in FIG. 9 resembles that of a pressure relief valve. When the pressure of the load-sense channel 108 pushes the slide 91 in direction A, a connection opens between the discharge channel 110 and the load-sense channel 108. The stronger the force the slide 91 is prevented from moving in direction A and open the connection to the discharge channel 110, the higher the pressure generated in the load-sense channel 108. The pressures of the chambers 97, 98 do not have any direct influence on the position of the slide 91, but the pressures of the chambers 97, 98 affect the position of the sleeve 96. The sleeve 96, in turn, enables the position of the slide 91 to be affected. The pressure surface in the sleeve 96 is substantially of a similar size towards both the rear chamber 98 and the front chamber 97. If the pressure in the sensing channel 99 is lower than that in the reference channel 100, the sleeve 96 moves in direction A, against a support sleeve 92. If the pressure in the sensing channel 99 is higher than that in the reference channel 100, the sleeve 96 moves to abut on the collar 95 of the slide 91. In such a case, the force pushing the sleeve 96 in direction B tries, together with the force of the spring 102, to resist the movement of the slide 91 in direction A. Since the slide 91 resists opening a connection to the discharge channel 110, a higher pressure may be active in the load-sense channel 108.

The ratio of the effective pressure variations in the sensing channel 99 and in the load-sense channel 108 stays constant. The magnitude of the pressure ratio depends on the internal structure of the monitoring valve 56, i.e. in this case on the ratio of the diameter of the bore 93, i.e. in practice the end surface area of the second end of the slide 91, and the end surface area of the sleeve 96. In the monitoring valve 56, the pressure ratio may be formed within quite a large range, the pressure ratio may be e.g. between 1:3 . . . 3:1. Changing the dimensions of the bores 94 and 93 enables monitoring valves with different pressure ratios to be provided. The pressure ratio changes when the ratio of the working pressure surface areas of a valve is changed.

An advantage of the construction described in FIG. 9 is e.g. that the slide 91 provides an accurate pressure value for the load-sense channel 108 without a disadvantageous hysteresis. Only cylindrical sealings are utilised between the slide 91, the sleeve 96 and the different bores. Correspondingly, the pressure in the sensing channel 99 enables an accurate adjustment to the pressure of the load-sense channel 108, without hysteresis.

Because the load-sense circuit 108 is arranged to flow into the discharge channel 110, no pressure fluid can flow from the load-sense channel 108 to the chamber 97 or 98 located further away at the mid-section of the slide 91. Thus hydraulic channels connected to chambers 97 and 98 are not disturbed by the variable load-sense flow from the channel 108. Chambers 97 and 98 can be considered to be substantially leakfree. The monitoring valve 56 is utilised in the FIGS. 5, 6, 7 and 8.

FIG. 10 shows a possible construction of another monitoring valve 71 utilised in the FIGS. 4 and 8. Differing from the monitoring valve shown in FIG. 9, the monitoring valve 71 can be constructed in such a manner that the collar 95 of the slide 91 is arranged to move in the front chamber 97 instead of the rear chamber 98. In comparison with the situation in FIG. 9, the sleeve 96 works by pushing the slide 91 to the opposite direction. In addition, the positions of the reference channel 100 and the sensing channel 99 are reversed. When the pressure of the sensing channel 99 increases above the pressure of the reference channel 100, the sleeve begins to reduce the force provided by the spring.

It is to be noted that the detailed structure of the monitoring valve 56 may deviate from the structure shown in FIG. 9, and that the detailed structure of the monitoring valve 71 may deviate from the structure shown in FIG. 10. A person skilled in the art may be capable of constructing a monitoring valve 56 or 71 according to the principle of the invention also in another way. Hence, the shape of the slide 91, the location of the channels 99, 110, 100 and 108 and, further, the force element 102 may also be constructed in another manner than that shown in the figures. For example, instead of a spring, another force element, such as a pressure accumulator or an electric actuator, may be used for pre-setting the monitoring valve 56.

It is further to be noted that as distinct from the above-disclosed figures, more than one pump may be provided. The feed actuator and the percussion device may be connected to a different pressure source. Furthermore, instead of the load-sense adjustment circuits shown in the figures, other ways known per se in hydraulic systems may also be used for adjusting the pressure of the pressure medium flow.

Furthermore, instead of an adjustable restrictor, a restrictor having a fixed setting may be arranged in the feed channel of the feed actuator, the restrictor being dimensioned or pre-set in a predetermined manner.

It is still noted that a restrictor refers to a component used in a pressure medium system, which causes throttling to a flow conveyed therethrough. The invention utilises a pressure drop caused by such a throttling.

The drawings and the related description are only intended to illustrate the idea of the invention. In its details, the invention may vary within the scope of the claims.

The invention claimed is:

1. A method for controlling rock drilling wherein a percussion device belonging to a rock drill machine delivers impact pulses to rock through a tool and wherein the rock drill machine is simultaneously pushed against the rock by means of a feed actuator the method, comprising:

feeding a pressure medium to the feed actuator along at least one feed channel;

feeding the pressure medium to the percussion device along at least one percussion pressure channel;

determining a penetration rate;

adjusting at least a percussion pressure on the basis of the penetration rate, conveying at least one pressure medium flow supplied to or from the feed actuator through at least one restrictor, sensing the pressure of the pressure medium before the restrictor and after the restrictor in order to determine the penetration rate, and adjusting the percussion pressure on the basis of the determined penetration rate.

2. A method as claimed in claim 1, further comprising:

interpreting that the penetration rate has increased when, due to pressure drops, the pressure after the restrictor is decreased relative to a reference pressure before the restrictor, and decreasing the percussion pressure when the penetration rate increases.

3. A method as claimed in claim 1, further comprising:

adjusting the percussion pressure in a predetermined manner with respect to the change of the penetration rate.

4. A method as claimed in claim 1, further comprising:

decreasing the percussion pressure and the feed pressure in a substantially constant ratio when the penetration rate increases.

5. A method for controlling rock drilling wherein a percussion device belonging to a rock drill machine delivers impact pulses to rock through a tool and wherein the rock drill machine is simultaneously pushed against the rock by means of a feed actuator the method, comprising:

feeding a pressure medium to the feed actuator along at least one feed channel;

feeding the pressure medium to the percussion device along at least one percussion pressure channel;

determining a penetration rate;

adjusting at least a percussion pressure on the basis of the penetration rate, conveying at least one pressure medium flow supplied to or from the feed actuator through at least one restrictor, sensing the pressure of the pressure medium before the restrictor and after the restrictor in order to determine the penetration rate, and adjusting the percussion pressure on the basis of the determined penetration rate;

measuring, by pressure sensors, the magnitude of the pressure active before the restrictor and the pressure after the restrictor, delivering pressure data to a control unit, determining, at the control unit, the penetration rate on the basis of the pressure data, and adjusting, by means of the control unit at least one electrically controlled valve in order to decrease the percussion pressure when the penetration rate increases.

6. A rock drilling arrangement comprising:

a rock drill machine including a percussion device arranged to generate impact pulses to a tool to be connected to the rock drill machine;

a feed beam whereon the rock drill machine has been arranged;

a feed actuator enabling the rock drill machine to be moved in the longitudinal direction of the feed beam;

a pressure medium system comprising: at least one pressure source; at least one pressure medium channel leading to the percussion device; at least one feed channel connected to the feed actuator; and means for adjusting a percussion pressure, and wherein at least one restrictor is connected to at least one feed channel of the feed actuator, the arrangement comprises means for sensing the pressure active in the feed channel before the restrictor and after the restrictor, means for determining the penetration rate on the basis of the sensed pressures before and after the restrictor and the pressure medium arrangement is arranged to decrease the percussion pressure when the penetration rate increases.

7. A rock drilling arrangement as claimed in claim 6, wherein a first sensing channel is connected to a section of the feed channel residing before the restrictor in the direction of flow and a second sensing channel is connected to a section after the restrictor, the first sensing channel is connected to a first pressure sensor and the second sensing channel is connected to a second pressure sensor, the arrangement includes at least one control unit, pressure data obtained from the first pressure sensor and pressure data obtained from the second pressure sensor m are arranged to be conveyed to the control unit, the control unit is arranged to monitor a penetration rate on the basis of the pressure data obtained from the pressure sensors, the control unit is provided with a control strategy for adjusting the percussion pressure in a predetermined manner with respect to the penetration rate;

and the arrangement includes at least one valve controlled by the control unit for adjusting the percussion pressure.

8. A rock drilling arrangement as claimed in claim 7, wherein the control unit is provided with a control strategy for adjusting a feed pressure in a predetermined manner with respect to the penetration rate, and the arrangement includes at least one valve controlled by the control unit for adjusting the feed pressure.

9. A rock drilling arrangement as claimed in claim 6, wherein the arrangement comprises at least one monitoring valve for adjusting the percussion pressure, the monitoring valve comprising:

a body, an elongated slide having a first end and a second end and arranged to a space in the body and movable in the longitudinal direction in said space, at least one force element that is arranged to act on the first end of the slide to move the slide towards a first direction of travel, and at least one controllable channel that is arranged to open and close by the longitudinal movement of the slide, the slide has at least one collar, a sleeve is arranged around the slide, the body has a space, inside which the collar and the sleeve are arranged to move, the outer rim of the sleeve is sealed to the body and the inner rim of the sleeve is sealed to the slide, the sleeve defines a first chamber and a second chamber on opposite sides of the sleeve, and said chambers are not connected to each other, the first chamber is connected at least to a first pressure channel, the second chamber is connected at least to a second pressure channel, the sleeve is arranged to move in the first or the second direction of travel depending on the pressure difference inside the chambers, and in one direction of travel, the sleeve is arranged to act on the axial position of the slide g when abutting on the collar.

10. A rock drilling arrangement as claimed in claim 9, wherein, in the monitoring valve, the sleeve is arranged to abut on the collar, on the same side as the force element, the first chamber is on the force element side of the sleeve and the, second chamber is on the collar side of the sleeve, the first chamber is connected to a sensing channel, the second chamber is connected to a reference channel, the sleeve is arranged to push via the collar the slide towards the first direction of travel, if the pressure of the sensing channel is higher than that of the reference channel.

11. A rock drilling arrangement as claimed in claim 9, wherein, in the monitoring valve, the sleeve is arranged to abut on the collar, on the opposite side of the collar with respect to the force element, the first chamber is on the force clement side of the sleeve and the second chamber is on the on the opposite side of the sleeve, the first chamber is connected to a reference channel, the second chamber is connected to a sensing channel, the sleeve is arranged to push via the collar the slide towards the second direction of travel, if the pressure of the sensing channel is higher than that of the reference channel.

12. A rock drilling arrangement as claimed in claim 9, wherein, in the monitoring valve, the force element is a spring and the pushing force of the spring is adjustable.

13. A rock drilling arrangement as claimed in claim 9, wherein, in the monitoring valve, the second end of the slide is arranged tightly to a bore in the body the pressure of the controllable channel is arranged to act on the end surface of the second end of the slide, the bore is connected to at least one transverse discharge channel, and the second end of the slide is arranged to open and close the connection between the controllable channel and discharge channel.

14. A rock drilling arrangement comprising:

a rock drill machine including a percussion device arranged to generate impact pulses to a tool to be connected to the rock drill machine;

a feed beam whereon the rock drill machine has been arranged;

a feed actuator enabling the rock drill machine to be moved in the longitudinal direction of the feed beam;

a pressure medium system comprising: at least one pressure source; at least one pressure medium channel leading to the percussion device; at least one feed channel connected to the feed actuator; and means for adjusting a percussion pressure, wherein the arrangement comprises at least one adjustment unit for controlling the feed actuator, at least two relief valves arranged in series in load-sense channel of the adjustment unit, at least one restrictor connected to the inlet feeding channel of the feed actuator, the arrangement comprises means for controlling the pressure difference between the inlet feeding channel of the feed actuator and a reference pressure sensed in-between the mentioned two relief valves in the load-sense circuit of the adjustment unit of the feed actuator, the reference pressure in-between the two relief-valves is sensed, the pressure after the restrictor is sensed, and the arrangement comprises a control system which is arranged to decrease the percussion pressure when the pressure difference between the abovementioned sensed pressures decreases.

15. A rock drilling arrangement as claimed in claim 14, wherein the restrictor is adjustable.

16. A rock drilling arrangement as claimed in claim 14, wherein the restrictor has fixed settings.

17. A rock drilling arrangement comprising:

a rock drill machine including a percussion device arranged to generate impact pulses to a tool to be connected to the rock drill machine;

a feed beam whereon the rock drill machine has been arranged;

a feed actuator enabling the rock drill machine to be moved in the longitudinal direction of the feed beam;

a pressure medium system comprising: at least one pressure source; at least one pressure medium channel leading to the percussion device; at least one feed channel connected to the feed actuator; and means for adjusting a percussion pressure, and wherein at least one restrictor is connected to at least one feed channel of the feed actuator along which the pressure medium returns from the feed actuator, the arrangement comprises means for sensing the pressure active in the feed channel before the restrictor and after the restrictor, means for determining the penetration rate on the basis of the sensed pressures before the restrictor and after the restrictor, and the pressure medium arrangement is arranged to decrease the percussion pressure when the penetration rate increases.

* * * * *